United States Patent [19]

Pfander

[11] 4,023,283

[45] May 17, 1977

[54] MOCCASIN-TYPE SHOE SEAM AND METHOD OF MANUFACTURING SAME

[75] Inventor: Wilhelm Pfander, Brewer, Maine

[73] Assignee: Penobscot Shoe Company, Old Town, Maine

[22] Filed: Aug. 9, 1976

[21] Appl. No.: 712,646

[52] U.S. Cl. ..... 36/11; 12/142 MC

[51] Int. Cl.[2] ..... A43B 3/14; A43D 9/00

[58] Field of Search ..... 36/11; 12/142 MC

[56] References Cited

UNITED STATES PATENTS

| | | | |
|---|---|---|---|
| 2,329,819 | 9/1943 | Braun | 36/11 |
| 2,931,653 | 1/1956 | Glassman | 36/11 |

FOREIGN PATENTS OR APPLICATIONS

| | | | |
|---|---|---|---|
| 2,225,037 | 5/1972 | Germany | 36/11 |

*Primary Examiner*—Patrick D. Lawson

[57] ABSTRACT

A moccasin-type shoe seam and method of manufacturing same wherein the plug is secured to the vamp by a handsewn seam concealing the cut or raw edges of the plug and vamp. The plug and vamp each are provided with two lines of perforations extending through the peripheral portion thereof. The lateral spacing between the lines of perforations in the plug and vamp is substantially the same. The longitudinal spacing between the perforations in the vamp is greater than the longitudinal spacing between the perforations in the plug. In the formation of the seam, the peripheral portion of the vamp is folded over to align the two lines of perforations therein, and the peripheral portion of the plug is folded over to align the two lines of perforations therein. The folded peripheral vamp portion then is sewn to the folded peripheral plug portion by passing a needle and thread alternately through aligned perforations in the plug to aligned perforations in the vamp and through aligned perforations in the vamp to aligned perforations in the plug. Because of the greater longitudinal spacing between the perforations in the vamp, its peripheral portion is gathered or folded in a predetermined manner the thread through two layers of the plug and two layers of the vamp in each stitch.

10 Claims, 6 Drawing Figures

FIG. 1
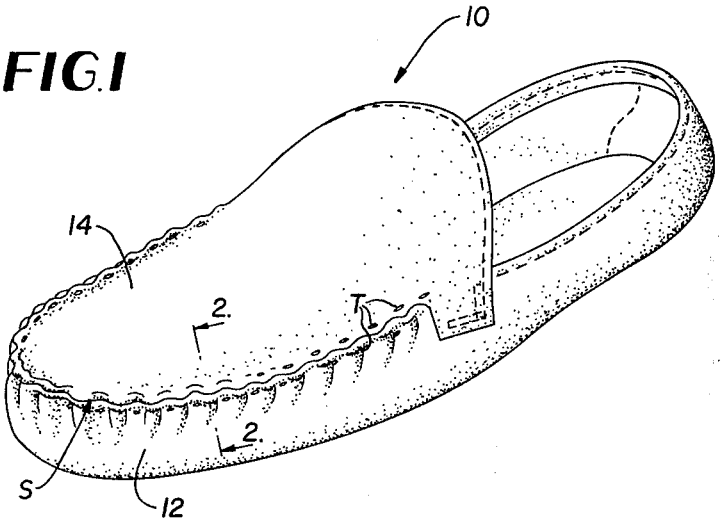
FIG. 2
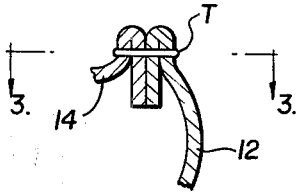
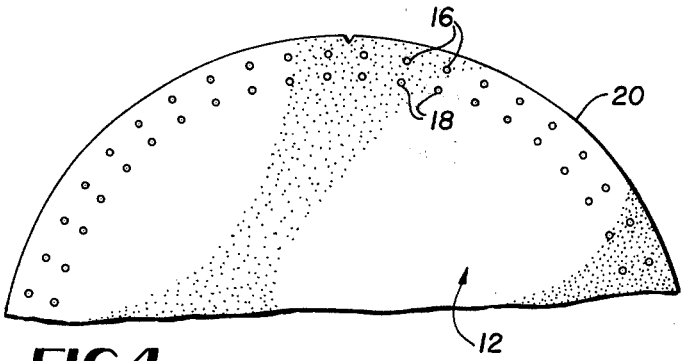
FIG. 4
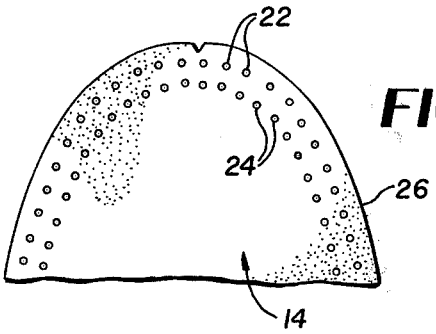
FIG. 5
FIG. 6
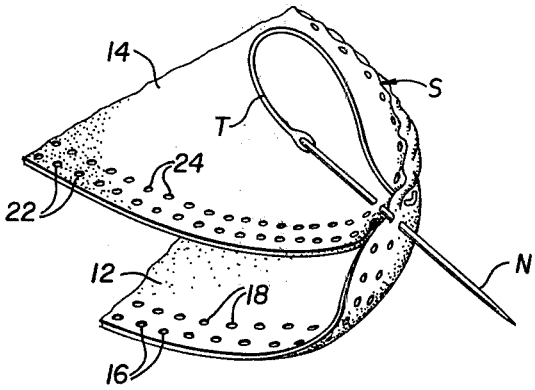
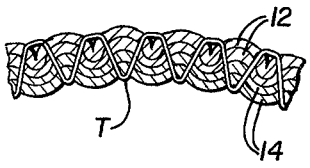
FIG. 3

MOCCASIN-TYPE SHOE SEAM AND METHOD OF MANUFACTURING SAME

BACKGROUND OF THE INVENTION

This invention relates to a moccasin-type shoe seam and, more particularly, to a seam between the plug and the vamp of a moccasin-type shoe and method of manufacuturing same. The term"moccasin" will be understood to mean a shoe in which a vamp, a part of the upper, underlies the wearer's foot, particularly in the toe area, and is joined by a seam to a toe-covering plug.

Conventionally, moccasins are hand assembled on a last by a tedious, time-consuming process requiring considerable skill. In the conventional process, a thoroughly mulled vamp is stretched progressively over a last as its edge is joined to that of a plug by a hand-formed moccasin seam, for example, a two thread through and through seam in which each thread passes through a stitch hole and alternately over the surface of the plug and of the vamp. In many cases, it is necessary to use a locking-type of stitch in order to ensure that the seam between the plug and the vamp will not come apart. Considerable skill is required because the seam not only joins the parts by also stretches the vamp and plug over the last to give the shoe its shape. Since the operator must exercise care to obtain acceptably uniform products, particularly in view of unavoidable variations in leather, the sewing of moccasins by hand is both time-consuming and expensive.

In many conventional moccasin seams of this type, the raw or cut edges of the plug and vamp are exposed in the finished seam, with the result that the seam does not have a finished or smooth appearance. Seam or binding constructions have been proposed for concealing these raw edges, but have involved complicated and/or costly methods of forming same.

SUMMARY OF THE INVENTION

The moccasin-type shoe seam of the present invention is simple in construction and relatively inexpensive to manufacture. Also, this seam does not require the use of a lock stitch and serves to conceal the raw or cut edges of the vamp and plug.

In the moccasin-type shoe seam of the present invention, the plug and vamp each are provided with two lines of perforations extending through the peripheral portion thereof. The lateral spacing between the lines of perforations in the plug and vamp is substantially the same. The longitudinal spacing between the perforations in the vamp is greater than the longitudinal spacing between the perforations in the plug.

In the formation of the seam, the peripheral portion of the vamp is folded over to align the two lines of perforations therein, and the peripheral portion of the plug is folded over to align the two lines of perforations therein. The folded peripheral vamp portion then is sewn to the folded peripheral plug portion by passing a needle and thread alternately through aligned perforations in the plug to aligned perforations in the vamp and through aligned perforations in the vamp to aligned perforations in the plug.

Because of the greater longitudinal spacing between the perforations in the vamp, its peripheral portion is gathered or folded in a predetermined manner in the seam when it is formed to simplify formation of the seam and to provide a uniform finished appearance of the seam. Also, a self-locking seam is produced by the passing of the thread through two layers of the plug and two layers of the vamp on each stitch, with the peripheral portion of the vamp being gathered more than that of the plug because of the larger longitudinal spacing between the vamp perforations.

BRIEF DESCRIPTION OF THE DRAWINGS

FIG. 1 is a perspective view of a moccasin-type shoe having a seam between the vamp and the plug formed in accordance with the principles of the present invention;

FIG. 2 is an enlarged partial sectional view taken substantially along line 2—2 in FIG. 1;

FIG. 3 is a sectional view taken substantially along line 3—3 in FIG. 2;

FIG. 4 is a plan view of a portion of the vamp prior to the formation of the seam of the present invention;

FIG. 5 is a plan view of a portion of the plug prior to the formation of the seam of the present invention; and FIG. 6 is a perspective view showing the formation of the seam of the present invention between the vamp and the plug.

DESCRIPTION OF THE PREFERRED EMBODIMENTS

FIG. 1 illustrates a moccasin-type shoe 10 having a seam S formed between the vamp 12 and the plug 14 of the shoe, in accordance with the principles of the present invention. The vamp 12 and plug 14 may be formed of any suitable material, such as leather, which may be provided with an internal layer (not shown) formed of a foamed or padded material or the like.

As shown in FIG. 4, prior to formation of the seam S, the peripheral portion of the vamp 12 is provided with two substantially parallel lines of perforations 16 and 18. The lines of perforations 16 and 18 extend substantially parallel to the cut or raw edge 20 of the vamp 12, and are formed therein in any suitable or conventional manner.

Similarly, prior to the formation of the seam S, two substantially parallel lines of perforations 22 and 24 are formed in the peripheral portion of the plug 14, as shown in FIG. 5. The lines of perforations 22 and 24 extend substantially parallel to the cut or raw edge 26 of the plug 14, and are formed therein in any suitable or conventional manner.

The lateral spacing between the lines of perforations 16, 18 in the vamp 12 and the lines of perforations 22, 24 in the plug 14 is substantially the same. The longitudinal spacing between the perforations in the vamp 12 preferably is greater than the longitudinal spacing between the perforations in the plug 14 to facilitate the formation of the seam S in a manner to be described hereinafter.

In the formation of the seam S, the peripheral portion of the vamp 12 is folded over to align the perforations 16 and 18 therein, and the peripheral portion of the plug 14 is folded over to align the perforations 22 and 24 therein, as generally shown in FIGS. 2 and 6. The folded peripheral portion of the vamp 12 then is sewn to the folded peripheral portion of the plug 14 by passing a needle N and thread T alternately through aligned perforations 16, 18 in the vamp 12 to aligned perforations 22, 24 in the plug 14, and through aligned perforations 22, 24 in the plug 14 to aligned perforations 16, 18 in the vamp 12, in the manner shown in FIGS. 2, 3 and 6.

Because the longitudinal spacing between the perforations 16, 18 in the vamp 12 is greater than the longitudinal spacing between the perforations 22, 24 in the plug 14, the peripheral portion of the vamp 12 is gathered or folded in a predetermined manner in the formation of the seam S. In this manner, the seam S can be formed between the vamp 12 and plug 14 without requiring the use of a last. By predetermining the longitudinal spacing between the perforations in the vamp 12 and those in the plug 14, the amount of gathering or folding of the peripheral portion of the vamp 12 may be predetermined in the finished seam S. Because the peripheral portions of the vamp 12 and plug 14 are folded inwardly in the seam S, the cut or raw edges of the vamp and plug are concealed in the finished seam, as illustrated in FIGS. 1, 2 and 6.

With the use of the seam and method of the present invention, a more complicated locking stitch is not required. The passing of the thread T through two layers of the vamp 12 and two layers of the plug 14, and the gathering of the peripheral portion of the vamp 12 owing to the difference in longitudinal spacing between the perforations in the vamp and the plug, serves to produce a self-locking seam with the use of the simple alternating stitch shown in FIGS. 3 and 6.

Preferably, the thread T is formed of a strong waxed nylon or other suitable material, and a needle N, or other suitable tool is utilized to advance the thread through the folded layers and aligned perforations of the vamp 12 and the plug 14 to form the seam S.

As shown in FIGS. 1 and 6, the seam S of the present invention provides a smooth finished appearance and conceals the cut edges of the vamp and plug. In addition, the seam S is strong, substantially waterproof and self-locking.

If desired, to achieve uniformity and lightness of seam, the peripheral portions of the vamp 12 and plug 14 may be skived in any suitable manner prior to the formation of the seam S.

Although the seam S of the present invention is provided in a moccasin-type shoe, it is noted that such a smooth, finished and self locking seam may be utilized with any suitable type of flexible materials to be joined together in a similar manner. Accordingly, the term "moccasin-type shoe" is intended to encompass any other articles wherein a similar seam could be provided.

What is claimed is:

1. A moccasin-type shoe comprising:

a vamp member having two lines of perforations extending through the peripheral portion thereof, said peripheral vamp portion being folded to align the two lines of perforations therein, and a plug member having two lines of perforations extending through the peripheral portion thereof, said peripheral plug portion being folded to align the two lines of perforations therein, the folded peripheral portion of said vamp member being secured to the folded peripheral portion of said plug member to conceal the edges thereof by a thread passing alternately through aligned perforations in said plug member to aligned perforations in said vamp member and through aligned perforations in said vamp member to aligned perforations in said plug member.

2. The shoe of claim 1 wherein the longitudinal spacing of the perforations in said vamp member is greater than the longitudinal spacing of the perforations in said plug member, whereby the peripheral portion of said vamp member is gathered by the thread securing it to said plug member.

3. The shoe of claim 1 wherein the lateral spacing between the lines of perforations in said vamp and said plug is substantially the same.

4. The shoe of claim 1 wherein the line of perforations in said vamp member are substantially parallel, and the lines of perforations in said plug member are substantially parallel.

5. The shoe of claim 4 wherein the lines of perforations in said vamp member are substantially parallel to the edge thereof, and the lines of perforations in said plug member are substantially parallel to the edge thereof.

6. A method of forming a seam between a vamp member and a plug member in moccasin-type shoe, comprising the steps of:

forming two substantially parallel lines of perforations in the peripheral portion of each of said vamp member and said plug member.

folding over the peripheral portion of each of said vamp member and said plug member to align the two lines of perforations therein, and securing together the folded peripheral portions of said vamp member and said plug member by passing a thread alternately through aligned perforations in said vamp member to aligned perforations in said plug member and through aligned perforations in said plug member to aligned perforations in said vamp member, whereby a seam is formed between said vamp member and said plug member wherein the edges thereof are concealed.

7. The method of claim 6 wherein the perforations formed in said vamp member are spaced longitudinally a greater distance than the longitudinal spacing of the perforations in said plug member to provide for the gathering of the peripheral portion of said vamp member to facilitate the formation of the seam between it and said plug member.

8. The method of claim 6 wherein the lines of perforations are formed in said vamp member in substantially parallel relation to the edge thereof, and the lines of perforations are formed in said plug member in substantially parallel relation to the edge thereof.

9. The method of claim 6 wherein the lateral spacing of the lines of perforations in said vamp member is substantially the same as the lateral spacing between the lines of perforations in said plug member.

10. The method of claim 6 wherein the peripheral portions of said vamp member and said plug member are skived prior to the formation of the seam therebetween.

* * * * *